United States Patent [19]

Philp

[11] 4,039,990

[45] Aug. 2, 1977

[54] SHEET-WOUND, HIGH-VOLTAGE COILS

[75] Inventor: Sanborn F. Philp, Pittsfield, Mass.

[73] Assignee: General Electric Company, Schenectady, N.Y.

[21] Appl. No.: 618,459

[22] Filed: Oct. 1, 1975

[51] Int. Cl.[2] ..... H01F 27/08

[52] U.S. Cl. ..... 336/60; 336/94; 361/35

[58] Field of Search ..... 336/60, 58, 94, 55, 336/62, 223; 174/17 GF, 15 R, 16 R; 317/243, 244

[56] References Cited

U.S. PATENT DOCUMENTS

| | | | |
|---|---|---|---|
| 1,912,903 | 6/1933 | Long | 336/60 X |
| 2,710,947 | 6/1955 | Gaston | 336/60 |
| 2,872,651 | 2/1959 | Treanor | 336/58 |
| 3,054,974 | 9/1962 | Rabins | 336/60 |
| 3,056,071 | 9/1962 | Baker et al. | 336/60 X |
| 3,201,727 | 8/1965 | Narbut et al. | 336/58 X |
| 3,201,728 | 8/1965 | McWhirter | 336/60 |
| 3,287,679 | 11/1966 | Jensen et al. | 336/94 |
| 3,386,060 | 5/1968 | Reber | 336/60 X |
| 3,447,112 | 5/1969 | Brorerman et al. | 336/60 |
| 3,748,616 | 7/1973 | Weber et al. | 336/60 |

*Primary Examiner*—Thomas J. Kozma

*Attorney, Agent, or Firm*—Marvin Snyder; Joseph T. Cohen; Jerome C. Squillaro

[57] ABSTRACT

An electrical coil comprised of sheet conductor is wound with dry film insulation between turns. The entire structure is maintained in a compressed gas environment, rendering harmless any small voids that may exist in the insulation. Cooling ducts of thin, cylindrical annuli are wound into the coil at intervals, and are completely sealed except for two places where they connect with inlet and outlet pipes.

10 Claims, 4 Drawing Figures

SHEET-WOUND, HIGH-VOLTAGE COILS

INTRODUCTION

This invention relates to sheet-wound, high-voltage electrical coils, and more particularly to apparatus for insulating and cooling such coils.

Conventional high-voltage power transformers presently can utilize no more than 20% of the core window area (i.e., the open area in a rectangular core) for accepting electrically conducting material. Any improvements in this utilization percentage would have great leverage on reduction in overall size and weight of the transformers, consequently reducing manufacturing costs. Doubling the utilization of the window area would make possible production of large power transformers having roughly one-third the weight and occupying only about one-third the volume of the equivalent design built according to present design practice. Present design practice is based on wire conductors, with mineral oil and cellulosic materials for insulation, and cooling accomplished by a combination of forced and natural convection-circulation of the mineral oil insulant.

A general approach to design of high-voltage power transformers exhibiting the aforementioned improvements may include use of sheet-wound coils, cooled by a system of sealed, self-contained, annular cooling ducts. Insulation may be provided by polymer film for turn-to-turn insulation, together with compressed gas insulation which is advantageously employed in large, high power coils. Coils of this type may employ conventional core material.

Accordingly, one object of the invention is to provide a sheet-wound coil useful for high voltage applications.

Another object is to provide a power transformer of reduced size and weight for any given electrical rating.

Another object is to provide a self-contained cooling system of simple design for a sheet-wound coil.

Briefly, in accordance with a preferred embodiment of the invention, an electrical coil comprises a conductive sheet and an insulating sheet overlaying the conductive sheet. The conductive sheet, together with the overlaid insulating sheet, is wound continuously in a plurality of turns about a magnetic core. The coil is immersed in, and surrounded by, an environment of gas at high pressure.

BRIEF DESCRIPTION OF THE DRAWINGS

The features of the invention believed to be novel are set forth with particularity in the appended claims. The inventionitself, however, both as to invention itself and method of operation, together with further objects and advantages thereof, may best be understood by reference to the following description taken in conjunction with the accompanying drawings in which:

DESCRIPTION OF TYPICAL EMBODIMENTS

Figure 1:
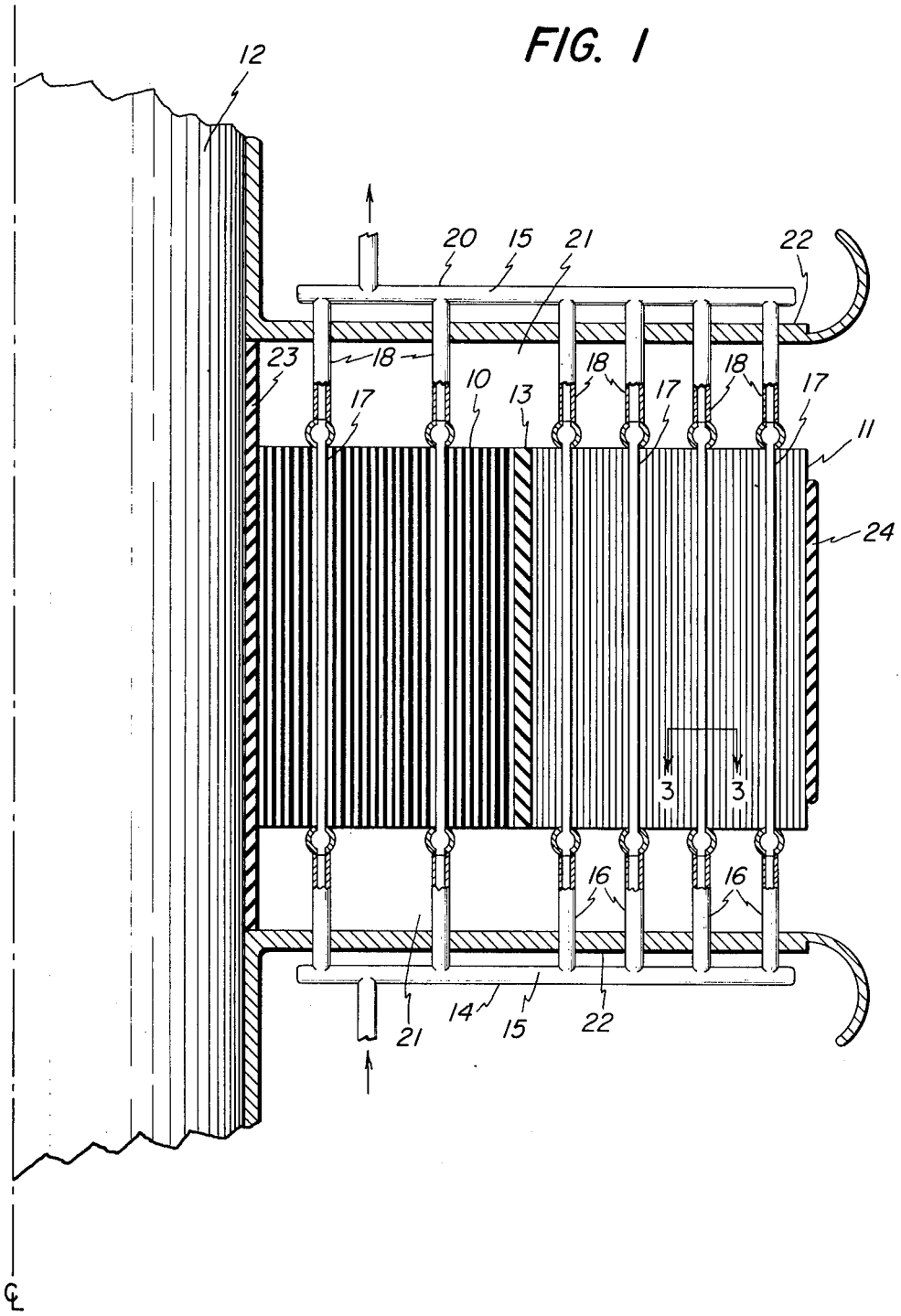
FIG. 1 is a longitudinal section view of transformer coils wound according to the teachings of the invention.

In FIG. 1, a sheet-wound power transformer is illustrated as comprising a low voltage sheet winding 10 wound about a magnetic core such as an iron core 12, typically of laminated construction, and a high voltage sheet winding 11 wound about winding 10. Insulation means 13 separates the high voltage winding from the low voltage winding, and acts as a reactance gap in the transformer. Each turn is insulated from the adjacent turn, as shown in detail in FIG. 2 wherein each turn 30 is separated from the adjacent turn by polymer film insulation 31. The polymer film may typically comprise two sheets of Mylar, a trademark of E. I. Du Pont de Nemours & Company of Wilmington, Del., for polyethylene terephthalate film. The winding material may be comprised of aluminum.

A shown in FIG. 1, inlet manifold 14 supplies a coolant 15 through inlet conduits 16 to cooling ducts 17 extending between adjacent or consecutive turns of the windings at locations in the windings selected to achieve sufficient cooling. This does not unduly increase the volume or weight of the transformer since the ducts are typically comprised of stainless steel walls that are either thin, substantially cylindrical annuli, or a plurality of closed sectors thereof. The ducts are wound into the coil at intervals determined by conventional temperature rise and heat flux calculations, so as to be spaced apart from each other by one or more intervening turns of the coil. The ducts are completely sealed except where they communicate with inlet and outlet conduits. Those skilled will recognize that the ducts may, in the alternative, be comprised of any suitable heat conducting metal.

Figure 2:
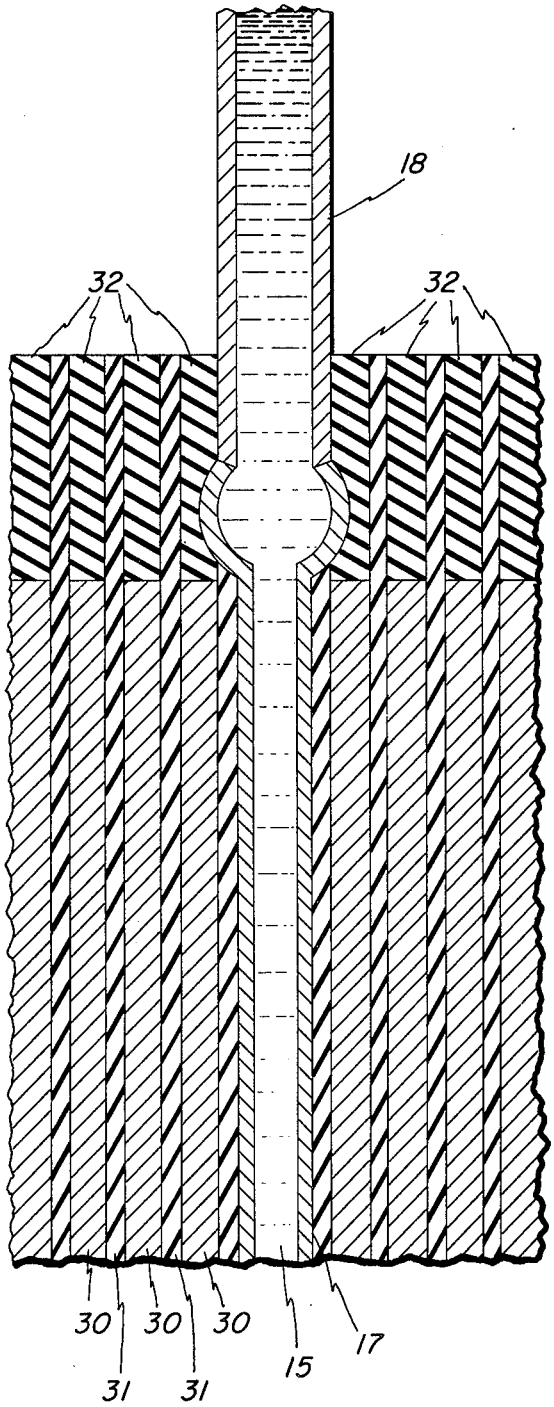
FIG. 2 is a magnified view of a portion of the apparatus shown in FIG. 1.

Coolant is removed from ducts 17 through outlet conduits 18 which discharge into an outlet manifold 20. Thus the cooling ducts, conduits and manifolds constitute a completely sealed, self-contained cooling system. A cooling duct 17 and outlet conduit 18 carrying coolant 15 are illustrated in greater detail in FIG. 2. Region 21 above and below windings 10 and 11 and reactance gap 13, and bounded at its extreme ends by a dielectric-coated shield 22, is occupied by compressed gas insulation which also fills the vessel (not shown) containing the transformer. In FIG. 2, insulation 32 is illustrated at the ends of turns 30 between layers of turn insulation 31. However, in some applications insulation 32 is unnecessary, as where the windings are self-supporting by winding the turns with high tension so that friction between the individual turns maintains the windings in position. Conduits 16 and 18, as shown in FIG. 1, need not pass through the core window, but advantageously are directed essentially parallel to the coil axes and outside of the core window.

As the coil is wound, innumerable small voids are created within the completed structure. To obviate any potential problems that might thus be created, the entire core and windings of the transformer are immersed in compressed gas such as sulfur hexafluoride in the pressure range of about 6-8 atmospheres absolute. Since the coil configuration is such that it may be successfully impregnated with compressed gas, voids of gas at low pressure pose essentially no problems because any voids within the insulation itself are thus small in thickness compared to the solid insulation thickness. The insulation, therefore, is effective since the electric stress, or potential gradient, which can be supported across an insulating gap increases as the gas void size diminishes;

that is, because the gas voids are small in thickness compared to the solid insulation, most of the voltage across the insulating gap is supported across the solid insulation. Electrical stresses in the voids, though higher than in the solid material, can nevertheless be successfully supported. The cooling ducts, pipes and manifolds do not carry the compressed gas and hence comprise a system entirely separate from the compressed gas-containing volume of the transformer housing or tank (not shown).

Alternatives to the techniques of interwound film insulation exist. For example, the coil, after being wound with means for spacing adjacent turns of conductor, could be impregnated with a liquid which is subsequently processed to form a solid insulation.

Inlet and outlet conduits 16 and 18, respectively, must be capable of insulating the voltage existing between either winding of the transformer and inlet and outlet manifolds 14 and 20, respectively, which are at ground potential. At least a portion of conduits 16 and 18 are therefore made of an electrical insulating material such as polytetrafluoroethylene, a ceramic, or rubber, and careful attention is given to forming a smooth joint between the insulating conduit and the metal duct structure to which it is attached. This is necessary since electric fields at these critical junctions must be kept as low as possible. Likewise, the coolant liquid itself must be a high voltage insulator in order to withstand the electrical stress across inlet and outlet conduits 16 and 18 if they are restricted to very short lengths. The coolant known as Freon 113, a trademark of E. I. Du Pont de Nemours & Company, is a suitable coolant for use in the apparatus for the invention. In applications of below approximately 50,000 volts, highly purified water may be a suitable coolant because of the relatively low electrical stress across the inlet and outlet conduits under these conditions.

In designing sheet-wound coils to withstand radial forces, the sheet windings themselves are treated as making no contribution to mechanical strength of the winding. The coils are typically wound as tightly as possible on an inner cylinder 23 of high strength material such as epoxy-fiberglass and the outer cylindrical surface is covered with another tightly-fitting cylinder 24 of high strength material such as epoxy-fiberglass. Reactance gap 13 may be comprised of a plurality of turns of the same polymer film used for insulating adjacent winding turns from each other, in sufficient number to provide adequate insulation between the low and high voltage windings. These cylinders provide essentially the entire radial strength of the coil. The radial strength requirement on the coil structure itself is, therefore, that the inner winding not be crushed nor the outer winding burst by the largest anticipated radial stress. This requirement is readily met, even for severe fault conditions (i.e., for induced radial stresses up to 1,000 pounds per square inch).

In the case of sheet windings, mechanical stresses are continuously distributed, and are not concentrated into individual current-carrying filaments as in conventional wire-wound coils. Although it may appear that the cooling ducts might be collapsed by the mechanical stresses arising under severe fault conditions, the ducts, being filled with liquid as are, also, all their connecting manifolds and tubes, actually experience negligible compression by these forces for the duration of the maximum AC fault wave which would be expected. Consequently the radial stress problem is much simpler to accommodate than in a conventional coil with its concentrated filaments of current in layers of wire would on discrete spacers.

Figure 3A:
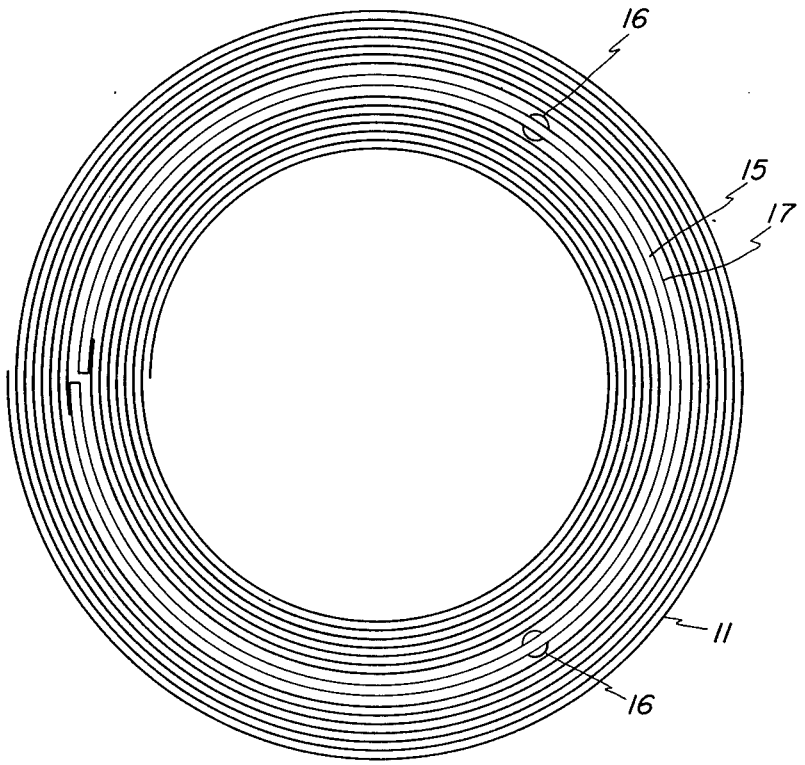
FIG. 3A is a cross sectional view along line 3—3 of FIG. 1 for one embodiment of a sheet-wound transformer coil.

FIG. 3A is a cross sectional view of sheet-wound transformer coil 11 along line 3—3 of FIG. 1, illustrating the location, in one embodiment, of a cooling duct 17 carrying coolant 15 within the winding. The locations of inlet conduits 16 are also shown. The locations of outlet conduits 18, not visible in FIG. 3A, are typically directly above inlet conduits 16, respectively. In this embodiment, electrically-conductive duct 17 itself constitutes a single turn of coil 11 by being joined at either end, as by welding, to the axially-interrupted sheet-wound conductor of coil 11.

Figure 3B:
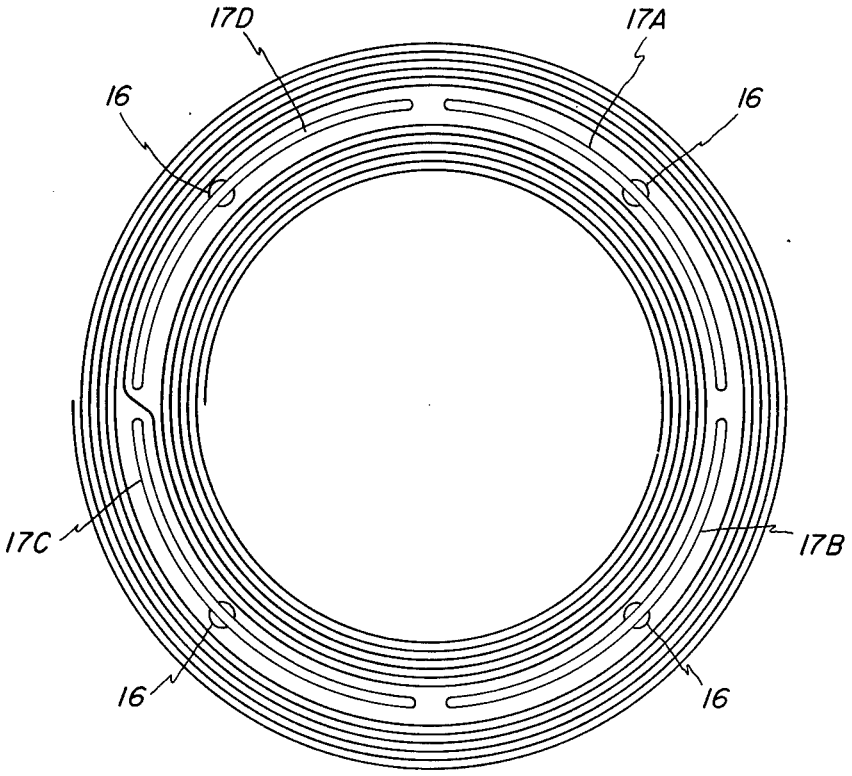
FIG. 3B is a cross sectional view along line 3—3 of FIG. 1 for another embodiment of a sheet-wound transformer coil.

FIG. 3B is a cross sectional view of sheet-wound transformer coil 11 along line 3—3 of FIG. 1, illustrating the location, in another embodiment, of a cooling duct between consecutive windings, split into segments 17A, 17B, 17C and 17D. Each segment communicates with at least one inlet conduit 16, as shown, and a corresponding outlet conduit, not visible in FIG. 3B, typically directly above each inlet conduit 16, respectively. In this embodiment, the windings and cooling ducts are electrically insulated from each other.

There exist certain additional mechanical and electrical advantages to the invention disclosed herein. Greater utilization of the core window area is made possible by the sheet-wound construction since the sheet conductor makes better use of available space by being continuous and uninterrupted in the axial direction. Additionally, the nearly perfect plane-to-plane insulating geometry achieved in the radial direction by virtue of the sheet-wound construction allows closer spacing between adjacent turns for any given voltage between the turns. Use of compressed gas insulation enables the transformer to withstand higher electrical stresses across its major spacings, such as the separation between a coil and the core material, so that these spacings can be held to small values. Moreover, the self-contained cooling system of the invention is far more efficient than conventional oil cooling since the coolant need not perform any insulating function within the coils themselves. This is because the metallic duct effectively shields the coolant from any electrical stress. Hence the coolant can be selected solely for its cooling capabilities; indeed, the self-contained cooling system allows coolant flow rates that are an order of magnitude greater than the forced flow velocity of insulating oil in conventional transformers, thus enhancing cooling efficiency. As a result of these advantages, core window utilization in sheet-wound transformers can be doubled to 40% and transformer weight reduced by a factor of three over conventional wire-wound transformers. A concomitant volume reduction is also realized. In addition to the foregoing advantages, superior performance is exhibited under impulse voltages since the extraordinarily high turn-to-turn capacitance of sheet windings provides a high degree of uniformity in distributing impulse voltages through the coil.

The foregoing describes a sheet-wound coil useful for high voltage applications. Use of the coil in power transformers or reactors allows such apparatus to be constructed of reduce size and weight for any given electrical rating. The invention further includes a self-contained cooling system of simple design for a sheet-wound coil.

While only certain preferred features of the invention have been shown by way of illustration, modifications and changes will occur to those skilled in the art. It is, therefore, to be understood that the appended claims are intended to cover all such modifications and changes as fall within the true spirit of the invention.

I claim:

1. An electrical coil comprising:

a conductive sheet;

an insulating sheet overlaying said conductive sheet;

a magnetic core, said conductive sheet overlaid by said insulating sheet being wound continuously in a plurality of turns about said core such that consecutive turns of conductive sheet and insulating sheet are in substantially continuous contact over their facing areas, the wound turns forming a structure having voids therein of small thickness relative to thickness of said insulating sheet;

means surrounding said coil with an environment of gas at high pressure such that said voids are filled with said gas; and a sealed cooling duct situated between two consecutive turns of said coil, said duct being connected to a supply of circulating coolant fluid.

2. The electrical coil of claim 1 wherein said duct is comprised of an electrically conductive material and is electrically connected to said coil so as to form at least a portion of a turn of said coil, said two consecutive turns being physically separate from each other.

3. An electrical coil comprising:

a conductive sheet;

an insulating sheet overlaying said conductive sheet;

a magnetic core, said conductive sheet overlaid by said insulating sheet being wound continuously in a plurality of turns about said core such that consecutive turns of conductive sheet and insulating sheet are in substantially continuous contact over their facing areas, the wound turns forming a structure having voids therein of small thickness relative to thickness of said insulating sheet;

means surrounding said coil with an environment of gas at high pressure such that said voids are filled with said gas; and a plurality of sealed cooling ducts situated between two consecutive turns of said coil, each of said ducts being connected to a supply of circulating coolant fluid.

4. An electrical coil comprising:

a conductive sheet;

an insulating sheet overlaying said conductive sheet;

a magnetic core, said conductive sheet overlaid by said insulating sheet being wound continuously in a plurality of turns about said core such that consecutive turns of conductive sheet and insulating sheet are in substantially continuous contact over their facing areas, the wound turns forming a structure having voids therein of small thickness relative to thickness of said insulating sheet;

means surrounding said coil with an environment of gas at high pressure such that said voids are filled with said gas; and a plurality of sealed cooling ducts, each of said ducts being situated respectively between consecutive turns, respectively, of said coil and spaced apart from each other by at least an intervening turn, each of said ducts being connected to a supply of circulating coolant fluid.

5. An electrical transformer comprising:

a core of magnetic material;

a first coil wound about said core, said first coil being formed from a first conductive sheet and a first insulating sheet overlaying said first conductive sheet such that consecutive turns of conductive sheet and insulating sheet are in sustantially continuous contact over their facing areas, said first coil having voids therein of small thickness relative to thickness of said first insulating sheet;

a second coil wound about said first coil, said second coil including a second conductive sheet and a second insulating sheet overlaying said second conductive sheet such that consecutive tunrs of conductive sheet and insulating sheet are in substantially continuous contact over their facing areas, said second coil having voids therein of small thickness relative to thickness of said second insulating sheet;

means surrounding said first and second coils with an environment of gas at high pressure such that said voids in said first and second coils are filled with said gas; and a sealed cooling duct situated between two consecutive turns of each of said coils, each of said ducts being connected to a supply of circulating coolant fluid.

6. The electrical transformer of claim 5 wherein at least one of said ducts is comprised of an electrically conductive material and is electrically connected to the two consecutive turns situated on either side thereof so as to form at least a portion of a turn of one of said coils, said two consecutive turns being physically separate from each other.

7. An electrical transformer comprising;

a core of magnetic material;

a first coil wound about said core, said first coil bein formed from a first conductive sheet and a first insulating sheet overlaying said first conductive sheet such that consecutive turns of conductive sheet and insulating sheet are in substantially continuous contact over their facing areas, said first coil having voids therein of small thickness relative to thickness of said first insulating sheet;

a second coil wound about said first coil, said second coil including a second conductive sheet and a second insulating sheet overlaying said second conductive sheet such that consecutive turns of conductive sheet and insulating sheet are in substantially continuous contact over their facing areas, said second coil having voids therein of small thickness relative to thickness of said second insulating sheet;

means surrounding said first and second coils with an environment of gas at high pressure such that said voids in said first and second coils are filled with said gas; and a plurality of sealed cooling ducts situated between two consecutive turns of at least one of said coils, each of said ducts being connected to a supply of circulating coolant fluid.

8. An electrical transformer comprising:

a core of magnetic material;

a first coil wound about said core, said first coil being formed from a first conductive sheet and a first insulating sheet overlaying said first conductive sheet such that consecutive turns of conductive sheet and insulating sheet are in substantially continuous contact over their facing areas, said first coil having voids therein of small thickness relative to thickness of said first insulating sheet;

a second coil wound about said first coil, said second coil including a second conductive sheet and a second insulating sheet overlaying said second conductive sheet such that consecutive turns of conductive sheet and insulating sheet are in substantially continuous contact over their facing areas, said second coil having voids therein of small thickness relative to thickness of said second insulating sheet;

means surrounding said first and second coils with an environment of gas at high pressure such that said voids in said first and second coils are filled with said gas; and in each of said coils, a plurality of sealed cooling ducts, each of said ducts being situated respectively between consecutive turns of each of said coils, respectively, said ducts being spaced apart from each other in each of said coils, respectively, by at least an intervening turn thereof, each of said ducts being connected to a supply of circulating coolant fluid.

9. The electrical transformer of claim 8 wherein said first and second coils are wound with sufficient tension to be maintained self-supporting on said core.

10. The electrical transformer of claim 5 wherein said fist and second coils are wound with sufficient tension to be maintained self-supporting on said core.

* * * * *